US012757998B2

(12) United States Patent
Drugeon et al.

(10) Patent No.: US 12,757,998 B2
(45) Date of Patent: Oct. 13, 2026

(54) PACKAGING AND APPLICATION DEVICE FOR A COSMETIC PRODUCT, KIT AND COVERING DEVICE

(71) Applicant: L'OREAL, Paris (FR)

(72) Inventors: Lionel Drugeon, Clichy (FR); Camille Schreiber, Clichy (FR); Gabriel Evain, Clichy (FR)

(73) Assignee: L'OREAL, Paris (FR)

( * ) Notice: Subject to any disclaimer, the term of this patent is extended or adjusted under 35 U.S.C. 154(b) by 664 days.

(21) Appl. No.: 17/413,238

(22) PCT Filed: Dec. 20, 2019

(86) PCT No.: PCT/EP2019/086759
§ 371 (c)(1),
(2) Date: Jun. 11, 2021

(87) PCT Pub. No.: WO2020/128019
PCT Pub. Date: Jun. 25, 2020

(65) Prior Publication Data

US 2022/0071373 A1 Mar. 10, 2022

(30) Foreign Application Priority Data

Dec. 20, 2018 (FR) ..... 1873637

(51) Int. Cl.
*A45D 40/02* (2006.01)
*A45D 40/00* (2006.01)
(Continued)

(52) U.S. Cl.
CPC ..... *A45D 40/10* (2013.01); *A45D 40/02* (2013.01); *A45D 40/16* (2013.01); *A45D 2040/0043* (2013.01); *A45D 2040/005* (2013.01)

(58) Field of Classification Search
CPC ..... A45D 40/06; A45D 40/16; A45D 2040/0043; A45D 2040/005
(Continued)

(56) References Cited

U.S. PATENT DOCUMENTS

| | | | | |
|---|---|---|---|---|
| 6,089,774 | A | 7/2000 | Franken et al. | |
| 8,807,148 | B2 | 8/2014 | Hermouet | |
| 2017/0265623 | A1* | 9/2017 | Kamboj | A45D 40/20 |

FOREIGN PATENT DOCUMENTS

| | | | |
|---|---|---|---|
| CN | 1144464 | A | 3/1997 |
| CN | 1284308 | A | 2/2001 |

(Continued)

*Primary Examiner* — Anthony D Stashick
*Assistant Examiner* — L Kmet
(74) *Attorney, Agent, or Firm* — POLSINELLI PC

(57) ABSTRACT

Packaging and application device for a cosmetic product, kit and covering device This device (10) comprises a first part (12) and a covering (16) that can be moved between an engaged position and a free position. The displacement between the engaged position and the free position is made by translation of the covering (16) along the longitudinal axis (D) away from the first part (12) from the second end (26) of the first part (12), The first part (12) or the covering (16) comprises at least one flexible indexing tab (56), the covering (16) or the first part (12) comprising an indexing surface (38). The movement from the engaged position to the free position can be controlled by manually pulling the covering (16) relative to the first part (12) in translation along the longitudinal axis (D) and away from the first part (12), manually pulling disengages the flexible indexing tab (56) from the indexing surface (38).

17 Claims, 4 Drawing Sheets

(51) Int. Cl.
*A45D 40/10* (2006.01)
*A45D 40/16* (2006.01)

(58) Field of Classification Search
USPC ..... 206/581
See application file for complete search history.

(56) References Cited

FOREIGN PATENT DOCUMENTS

| | | | | | |
|---|---|---|---|---|---|
| CN | 102781277 | A | | 11/2012 | |
| CN | 107518564 | A | | 12/2017 | |
| DE | 1467713 | A1 | | 1/1969 | |
| EP | 3469947 | A1 | | 4/2019 | |
| FR | 1 118 520 | A | | 6/1956 | |
| FR | 2 502 471 | A1 | | 10/1982 | |
| GB | 731013 | A | | 6/1955 | |
| JP | 2000300334 | A | | 10/2000 | |
| WO | WO-2008064448 | A1 | * | 6/2008 | ..... A45D 40/06 |
| WO | 2014073819 | A1 | | 5/2014 | |

* cited by examiner

PACKAGING AND APPLICATION DEVICE FOR A COSMETIC PRODUCT, KIT AND COVERING DEVICE

CROSS REFERENCE TO RELATED APPLICATIONS

This application is a National Phase filing under 35 U.S.C. § 371 of PCT/EP2019/086759 filed on Dec. 20, 2019; which application in turn claims priority to Application No. 18 73637 filed in France on Dec. 20, 2018. The entire contents of each application are hereby incorporated by reference.

This invention relates to a packaging and application device for a cosmetic product, comprising:

- a first part for containing a cosmetic product, the first part extending along a longitudinal axis between a first end and a second end,
- a covering able to be moved between an engaged position, in which the covering covers at least partly the first part, and a free position, in which the covering is separated from the first part.
- the displacement between the engaged position and the free position being made by translation of the covering along the longitudinal axis away from the first part from the second end of the first part.

The invention also relates to a kit comprising such a device

A cosmetic product is advantageously a product as defined in EC Regulation No 1223/2009 of the European Parliament and the Council of Nov. 30, 2009, relating to cosmetic products.

Such a covering makes it possible in particular to improve the external aspect of the packaging and application device for a cosmetic product, by providing an aesthetically pleasing covering. The covering may also be adapted to suit the wishes of the user.

WO0178551 describes a cosmetic product application device, more particularly a lipstick, wherein the lipstick mechanism containing the cosmetic product is covered by a removable covering. The removable covering is held by cooperation of grooves and beads and can be separated from the lipstick mechanism by pushing on the mechanism to disengage it.

Such a device does not provide full satisfaction. In particular, the mechanism can be pushed accidentally and cause unwanted separation of the lipstick mechanism and the covering.

Furthermore, the covering retaining force is not controlled and depends on manufacturing tolerances and wear of parts that compose the retaining mechanism. The retention of the mechanism in the covering reduces after a certain time One purpose of the invention is to disclose a packaging and application device with removable covering, that can easily be removed but only by a deliberate and reproducible action by the user.

To achieve this, the purpose of the invention is a packaging and application device for a cosmetic product of the type mentioned above, characterized in that one of the first part and the covering comprises at least one flexible indexing tab, and the other of the first part and the covering comprises an indexing surface, the flexible indexing tab being able to engage reversibly with the indexing surface to hold the covering in the engaged position, and in that the movement from the engaged position to the free position can be controlled by manually pulling the covering relative to the first part in translation along the longitudinal axis and away from the first part, manually pulling disengaging the flexible indexing tab from the indexing surface.

The flexible tab and the indexing surface making the connection between the first part and the covering are disassembled by pulling the covering manually from the first part, which cannot be done without deliberate action by the user. Consequently, disassembly of the covering from the first part is very reproducible because of cooperation between the flexible tab and the indexing surface and cannot take place accidentally.

According to the invention, the movement from the engaged position to the free position can be made only by translation of the first part relative to the covering without movement of an element of the first part relative to the remainder of the first part and without movement of an element of the covering relative to the remainder of the covering other than a movement of the indexing tab.

All that is necessary to separate the first part and the covering is translation of the first part relative to the covering. Consequently, disassembly is simple and fast.

Depending on the variants:

- the covering comprises a peripheral wall and a back wall substantially orthogonal to the longitudinal axis, the peripheral wall and the back wall delimiting a reception cavity of the first part, the back wall being permanently fixed relative to the peripheral wall and closing the reception cavity;
- the covering and the first part comprise a tube with an internal peripheral surface, the indexing surface being defined on the tube.

Since the back wall forms the covering, the indexing surface defined on the band cannot be accessed from the outside. Thus, the indexing elements conferring strength on the covering and the first part make for a secure and reliable assembly. Furthermore, the back wall assures that the visual appearance of the device is uniform, by masking the mechanism and providing improved aesthetics.

Depending on the variants:

- the flexible indexing tab projects longitudinally and can be deformed transversely between a rest position engaged on the indexing surface and a deformed position clear of the indexing surface;
- the deformable flexible indexing tab can move from the rest position to the deformed position only by pulling the first part relative to the covering along the longitudinal axis, the pulling advantageously being less than 20 N, particularly less than 15 N and advantageously comprised between 5 N and 20 N.

Deformability of the flexible tab facilitates disassembly by pulling the first part relative to the covering.

According to one variant, the flexible indexing tab comprises a longitudinal body and a head projecting radially from the longitudinal body applied on the indexing surface.

The radial projecting head on the flexible tab applied on the indexing surface of the first part guarantees a reliable assembly of the covering and the first part.

According to one variant, the device comprises a single flexible indexing tab for cooperating with the indexing surface.

The device only requires a single flexible tab. Thus, it is easy to fabricate and to use.

According to one variant, the first part comprises the flexible indexing tab, the covering defining the indexing surface.

Installation of the flexible tab on the first part rather than on the covering even further simplifies manufacturing.

According to one variant, the first part is a support and deployment mechanism for a block of cosmetic product, particularly a stick of lipstick, the mechanism comprising a cup that can be displaced longitudinally between a retracted position and an extended position.

The device can advantageously be applied to lipsticks, the first part being a lipstick mechanism comprising a cup containing the cosmetic product to be applied.

Another purpose of the invention is a kit containing a packaging and application device for a cosmetic product like that defined above and a refill comprising a first additional part similar to the first part, the first additional part extending along a longitudinal axis between a first end and a second end, the covering being able to be moved between an engaged position in which the covering at least partly covers the first additional part, and a free position in which the covering is separated from the first additional part, the displacement between the engaged position and the free position being made by translation of the covering along the longitudinal axis around the first additional part from the second end of the first additional part.

According to one variant, the kit comprises a substitution covering, distinct from the covering, the substitution covering being able to be moved between a free position in which the substitution covering is separated from the first part and an engaged position in which the substitution covering at least partly covers the first part, the displacement between the free position and the engaged position being made by translation of the substitution covering along the longitudinal axis around the first part from the second end of the first part.

The kit can be used to replace the first part containing the refill of the cosmetic product while keeping the covering. The device thus advantageously makes it possible to reuse the covering and therefore to limit waste derived from use of said cosmetic product.

Another purpose of the invention is a method for covering/uncovering a packaging and application device for a cosmetic product, comprising the following steps:

- providing a first part extending along a longitudinal axis between a first end and a second end,
- providing a covering, one of the first part and the covering comprising a flexible indexing tab, and the other of the first part and the covering comprising an indexing surface,
- displacing the covering towards an engaged position, in which the covering at least partly covers the first part, the displacement being carried out by translation of the covering along a first direction along the longitudinal axis, from the second end of the first part, the flexible indexing tab being reversibly engaged with the indexing surface in order to hold the covering in the engaged position,
- manually pulling to displace the covering from the engaged position to a free position, in which the covering is separated from the first part, the displacement being carried out by translation of the covering along a second direction opposite to the first direction along the longitudinal axis, from the second end of the first part.

According to one variant, the movement from the engaged position to the free position is made exclusively by pulling the covering relative to the first part along the longitudinal axis and away from the first part, the pulling disengaging the flexible indexing tab and the indexing surface, without movement of an element of the first part relative to the remainder of the first part and without movement of an element of the covering relative to the remainder of the covering other than the movement of the flexible indexing tab.

Other features and advantages of the invention will become clear after reading the following description given solely as an example with reference to the appended drawings wherein.

A device 10 for packaging and application of the cosmetic product is shown in FIGS. 1 to 4.

The device 10 comprises a first part 12, a covering 16 for at least partly covering the first part 12 and advantageously, a closing element 18, to be removably mounted on the covering 16.

Figure 1:
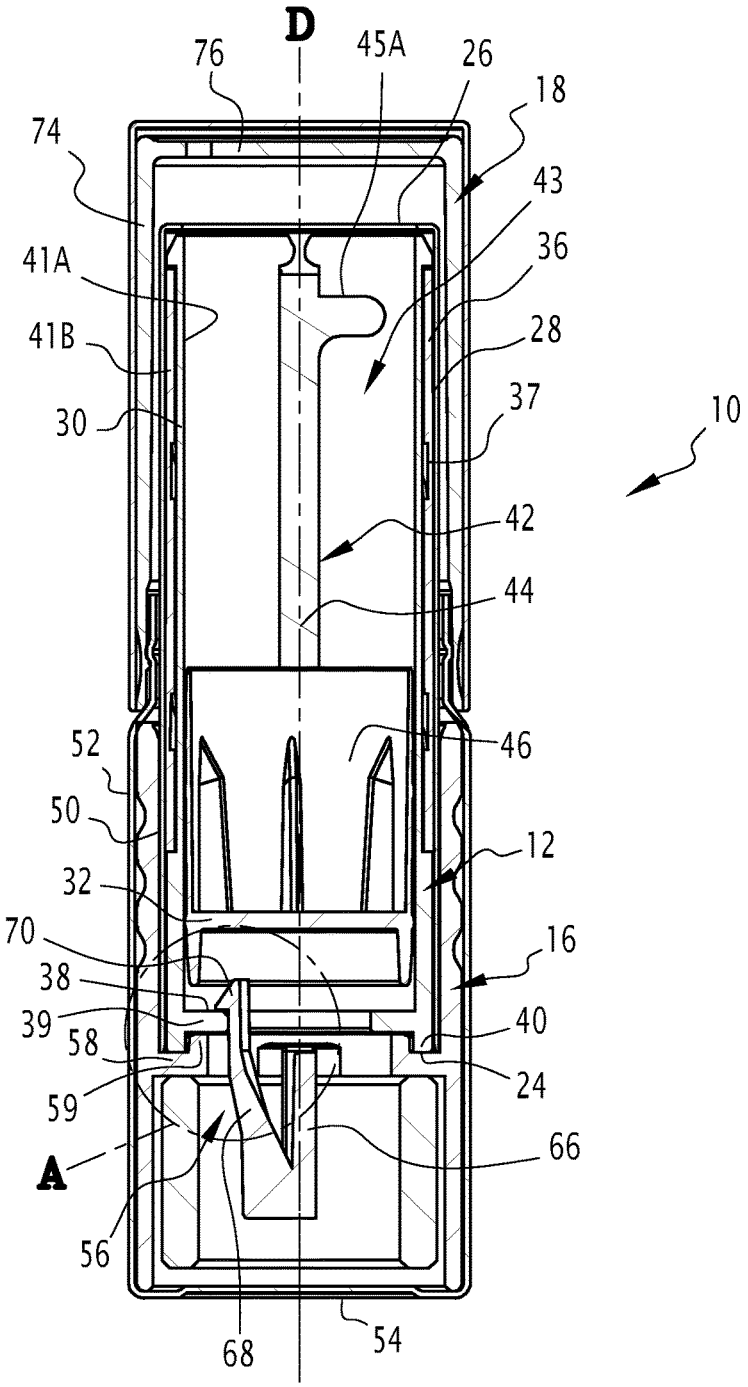
FIG. 1 is a sectional view of a packaging and application device for a cosmetic product.

The first part 12 extends along a longitudinal axis D that can be seen on FIG. 1 between a first end 24 at the bottom in FIG. 1, and a second end 26 at the top in FIG. 1.

In the example represented on the figures, the first part 12 is a support and deployment mechanism for a cosmetic product stick, particularly a stick of lipstick. The mechanism comprises an external band 28, a guide tube 30 and a cup 32.

The band 28 extends along the longitudinal axis D. It comprises an inner peripheral surface 36 and an outer peripheral surface 37.

The inner peripheral surface 36 of the band 28 defines at least one helical groove 36A extending between the first end 24 and the second end 26 of the band 28.

The band 28 is mounted free to rotate about the axis D of the guide tube 30.

The guide tube 30 extends along the longitudinal axis D. It has an inner peripheral surface 41A, an outer peripheral surface 41B and delimits at least one longitudinal guide slit 42 opening up through the surfaces 41A and 41B.

The guide tube 30 and the band 28 form two concentric cylinders with longitudinal axis D. The outer peripheral surface 41B of the guide tube 30 is substantially in contact with the inner peripheral surface 36 of the band 28.

The guide tube 30 delimits an internal opening 43 for circulation and guidance of the cup 32. The opening 43 opens up at the second end 26 of the band 28.

Each guide slit 42 is formed in the guide tube 30.

Each slit 42 opens up radially towards the axis D in the internal opening 43 and comprises an axial central main segment 44 and two circumferential end segments 45A.

The circumferential end segment 45A extends from one end of the main axial segment 44 in a first direction around the axis D. The circumferential end segment extends from the other end of the main axial segment 44 in a second direction opposite the first direction.

The inner peripheral surface 41A of the guide tube 30 has a radial projection 39 at the end 24 of the first part 12 extending around the entire circumference of the band 28 and extending towards the longitudinal axis D.

The radial projection 39 defines an indexing surface 38 around its entire circumference, extending transversely relative to the longitudinal axis D in the direction of the second end 26.

The guide tube 30 comprises a lower edge 40 fixed in rotation with the covering 16. The lower edge 40 comprises a toothed axial ring 40A (visible on FIG. 4) extending around the longitudinal axis D, projecting from the indexing surface 38.

The cup 32 comprises a receptacle 46 to support the block of cosmetic product (in this case a stick of lipstick not shown on the figures), and for each guide slit 42, a radial guide pin 47 that fits into both a slit 42 in the guide tube 30 and in a helical groove 36A of the band 28.

During the relative rotation between the band 28 and the guide tube 30, the cup 32 is free to move in translation along the axis D between a retracted position in which the cup 32 is closest to the first end 24 of the first part 12 and a fully extended position in which the cup 32 is moved away from the first end 24.

When the cup 32 is in its retracted position, each radial guide pin 47 fits into a circumferential end segment. When the cup 32 is in its fully extended position, each radial guide pin 34 fits into a circumferential end groove 45A. Between each of these positions, each radial guide pin 47 fits into the main axial segment 44.

The covering 16 can be moved in translation between the longitudinal axis D relative to the first part 12 between an engaged position (FIG. 1) in which the covering 16 at least partly covers the first part 12 and a free position in which the covering 16 is separated from the first part 12.

The covering 16 comprises an internal peripheral wall 50, an external peripheral wall 52 arranged around the internal peripheral wall 50, and a back wall 54 closing the external peripheral wall 52. The covering also comprises a material bridge 55 passing through the wall 50 and at least one flexible indexing tab 56 carried by the material bridge 55, in the internal peripheral wall 50.

The internal peripheral wall 50 of the covering 16 has a shape substantially conjugate to the external peripheral surface 37 of the band 28 and at least partly covers the first part 12.

It comprises a circumferential radial collar 58 extending towards the longitudinal axis D.

The radial collar 58 comprises a toothed annular bead 59 complementary to the toothed annular axial ring 40A of the guide tube 30, at its free end.

The radial collar 58 and the toothed annular bead 59 define an annular stop on which the lower edge 40 of the band 28 rests.

In this position, the toothed annular bead 59 and the toothed ring 40A cooperate with each other to fix the guide tube 30 and the covering 16 in rotation around the axis D.

The external peripheral wall 52 covers the internal peripheral wall 50 and defines a surface with the outside appearance of the covering.

The back wall 54 closes the covering 16 at one end of the covering 16. It cooperates with the internal peripheral wall 50 to form a reception cavity for the first part 12. The back wall 54 is substantially orthogonal to the longitudinal axis D. It is fixed relative to the external peripheral wall 52 and relative to the internal peripheral wall 50.

In this example, the back wall 54 is integral with the external peripheral wall 52.

The material bridge 55 extends between a first point on the circumferential radial collar 58 and a second point diametrically opposite the first point on the radial collar 58.

The material bridge 55 and the radial collar 58 are advantageously made in a single piece from the same material.

The flexible indexing tab 56 extends substantially longitudinally in the reception cavity. It comprises a fixed base 66, and a flexible region comprising a longitudinal body 68 and a head 70 projecting radially from the longitudinal body 68.

The fixed base 66 extends along the longitudinal axis D from the material bridge 55 towards the back wall 54.

The longitudinal body 68 projects from the fixed base 66 towards the first part 12.

It can be deformed transversely between a rest position in which the tab 56 cooperates with the radial projection 39 of the band 28 in the engaged position of the covering 16 and a deformed position in which the tab 56 is away from the radial projection 39 towards the longitudinal axis D.

The longitudinal body 68 can be deformed transversely by the user manually pulling the covering 16 relative to the first part 12 in translation along the longitudinal axis D away from the first part 12.

The maximum pulling that the user needs to apply along the axis D to cause deformation of the tab 56 and detachment of the covering 16 from the first part 12 may for example be less than 20 N and in particular less than 15 N.

The minimum pulling that the user needs to apply along the axis D to cause deformation of the tab 56 and detachment of the covering 16 from the first part 12 may for example be more than 5 N, and advantageously be between 5 N and 20 N.

The above-mentioned minimum pulling value guarantees that the covering 16 remains attached on the first part 12, particularly during storage and use of the device 10. The above-mentioned maximum pulling value is sufficient to detach the covering 16 from the first part 12 when they have to be separated, without effort and at a reproducible force.

In the example in FIG. 1, the head 70 of the flexible indexing tab 56 cooperates with the indexing surface 38 of the band 28 in the engaged position of the covering 16. The tab 56 is then in its rest position in which the radially projecting head 70 bears on the indexing surface 38 located on the radial projection 39 of the band 28.

Cooperation between the tab 56 and the indexing surface 38 prevents axial displacement of the first part 12 relative to the covering 16 when there is no pulling along the axis D between the first part 12 and the dressing 16.

In the deformed position of the tab 56, the head 70 has been pushed by the free edge of the radial projection 39 and is no longer in contact with the indexing surface 38 located on the radial projection 39 of the band 28. The first part 12 of can then be displaced axially away from the covering 16.

Figure 2:
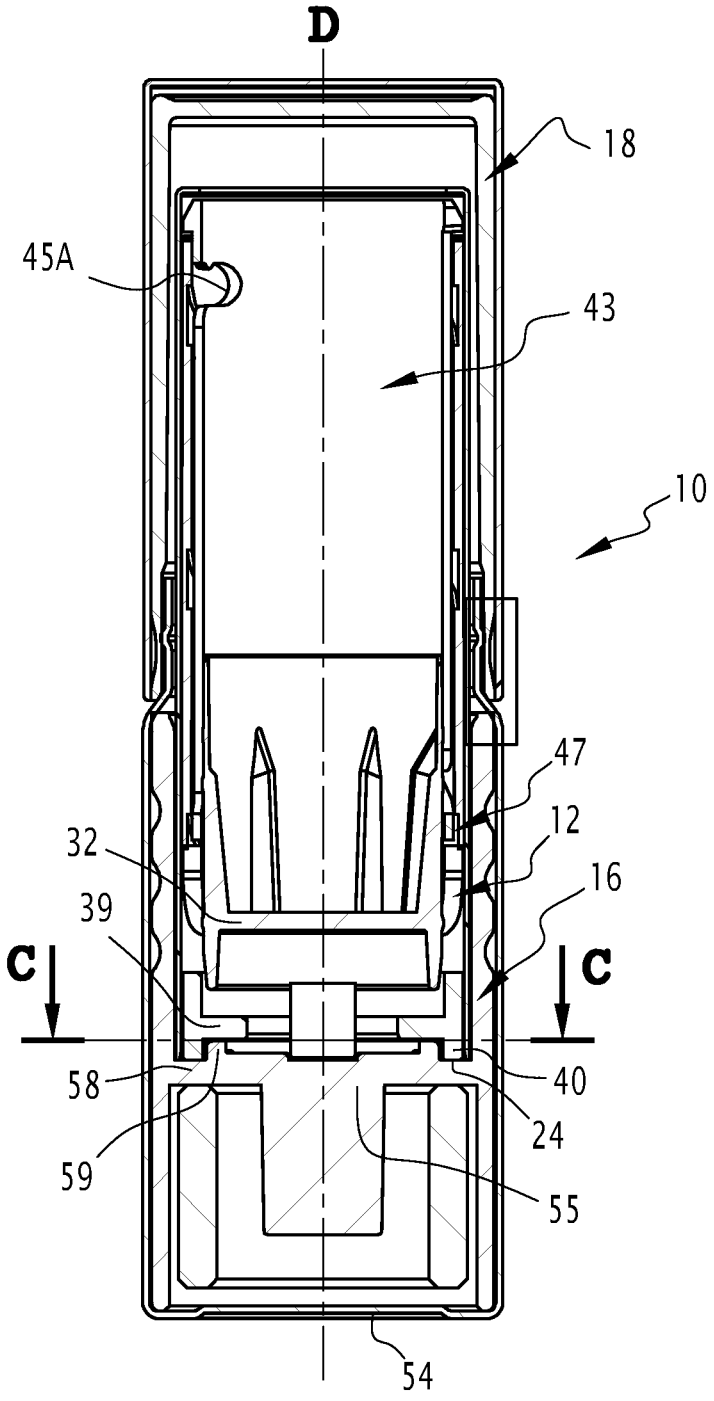
FIG. 2 is a sectional view of the device in FIG. 1, perpendicular to the section in FIG. 1.
Figure 3:
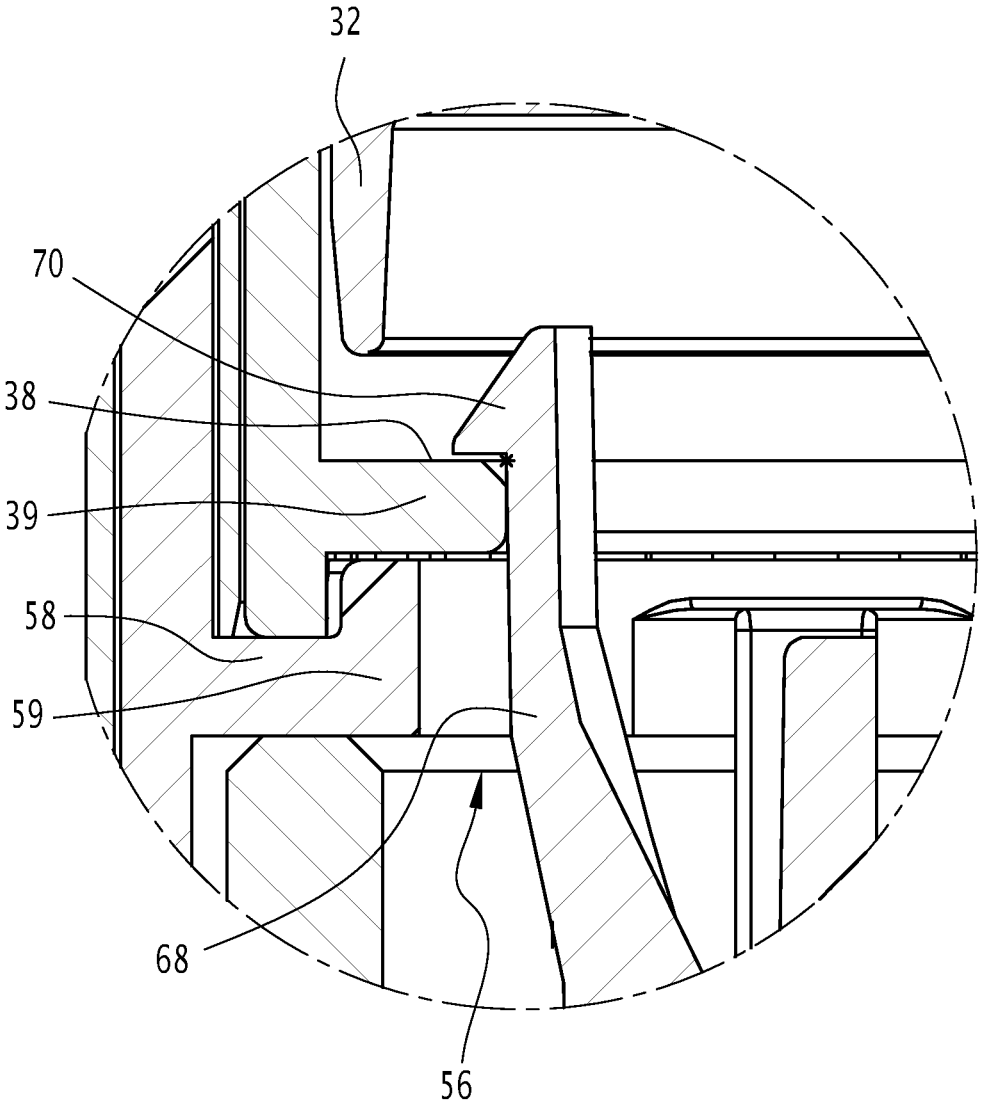
FIG. 3 is an enlarged view of zone A in FIG. 1.
Figure 4:
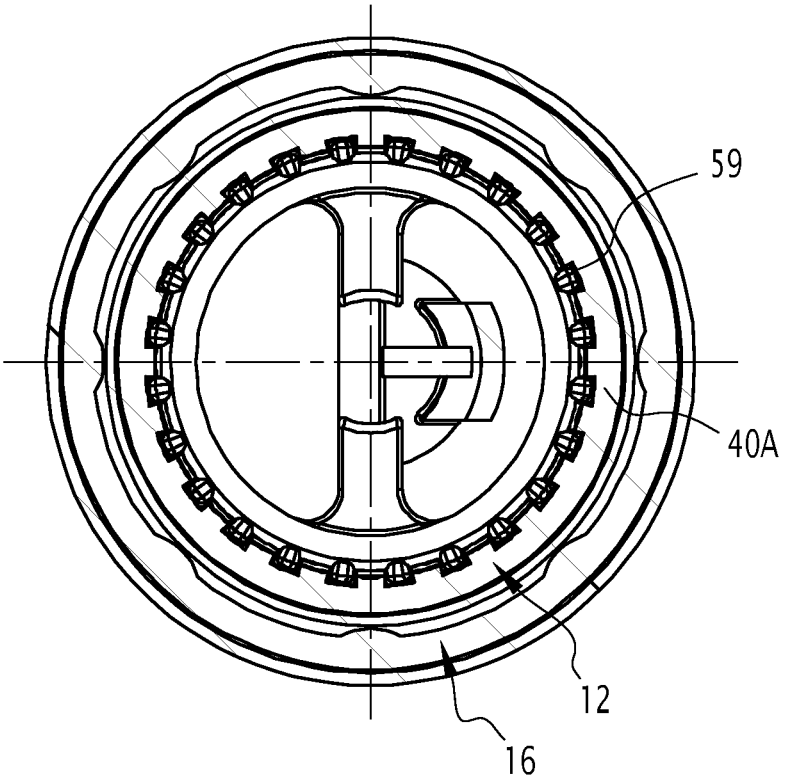
FIG. 4 is a sectional view of the device in FIG. 2 along section C-C.

In the example shown on FIGS. 1 and 2, the closing element 18 is a cap at least partly covering the first part 12 by engaging on the covering 16.

The closing element 18 comprises a skirt 74 and an end wall 76 closing the skirt 74 at one end.

A method for covering/uncovering an application device 10 like that described above will now be described.

Initially, a first part 12 and a covering 16 like those described above are provided, advantageously with a closing element 18.

The covering 16 is separated from the first part 12 and from the closing element 18.

The covering 16 is displaced between the engaged position in which the covering 16 covers at least partly the first part 12. The displacement is made by translation of the covering 16 along the longitudinal axis D around the first part 12 from the second end 26 of the first part 12.

The flexible indexing element 56 of the covering 16 then engages with the indexing surface 38 of the band 28 in such a way as to hold the covering 16 engaged around the first part 12.

Similarly, the lower edge 40 of the band 28 bears on the radial collar 58. The toothed annular bead 59 of the covering 16 and the toothed ring 40A of the first part 12 cooperate to fix the guide tube 30 and the covering 16 in rotation about the axis D.

To use the device 10, a user grips the covering 16 and moves the closing element 18 away from the covering 16 and the first part 12 by moving it along the longitudinal axis D.

The user then rotates the band 28 around the longitudinal axis D relative to the covering 16 in a first direction to move the cup 32 towards its extended position. This at least partly extracts the block of cosmetic product outside the internal opening 43 in the guide tube.

The user then applies the cosmetic product onto a body surface.

To put the cosmetic product back into its storage, the user rotates the band 28 around the longitudinal axis D relative to the covering 16, in a second direction opposite to the first direction.

The cup 32 then moves towards its retracted configuration until each guide pin 47 is inserted in a circumferential end segment.

The closing element 18 is then replaced on the covering 16 and the first part 12 by displacing it along the axis D towards the first part 12.

The invention also relates to a kit comprising a packaging and application device 10 for a cosmetic product as described above, a refill and/or a substitution covering.

The refill comprises a first additional part similar to the first part 12. The substitution covering has an internal structure similar to the internal structure of the covering.

To replace the first part 12 by the refill or the covering 16 by the substitution covering, the covering 16 is moved between the engaged position in which the covering 16 at least partly covers the first part 12, and the free position in which the covering 16 is separated from the first part 12. Displacement between the engaged position and the free position is then made by manually pulling the covering 16 along the longitudinal axis D relative to the first part 12.

The pulling causes transverse deformation of the longitudinal body 68 of the flexible tab 56 towards the longitudinal axis D. This disengages the head 70 from the flexible indexing tab 56 and the indexing surface 38, without an element of the first part 12 moving relative to the remainder of the first part 12 and without movement of a covering element 16 relative to the remainder of the covering 16 other than movement of the flexible tab 56.

In particular, there is no need to equip the covering 16 with a device for radial displacement of the flexible tab 56 such as a pusher. Therefore the structure of the device 10 is simplified and its cost is reduced. Furthermore, its external appearance is improved because the back wall 54 remains permanently fixed.

The user then moves the covering 16 in translation along the axis D, from the engaged position to the free position, in which the covering 16 is separated from the first part 12 and from the closing element 18.

The refill is then introduced into the covering 16 in replacement of the first part 12. As a variant, the first part 12 is introduced into the substitution covering, as described above.

Therefore it is easy to replace the first part 12 by the refill, without replacing the covering 16, or to replace the covering 16 by the substitution covering, without replacing the first part 12. This reduces the quantity of waste produced by the replacement.

In this example, the cosmetic product contained in the refill is similar to or identical to the cosmetic product contained in the first part 12.

As a variant, the cosmetic product contained in the refill is different from the cosmetic product contained in the first part. The user can then vary the cosmetic product used by displacing the covering on the desired part.

The same covering can thus be used for a multitude of parts in such a way as to form a packaging and dispensing device adapted to the desires of the user.

This allows a user to refill the device when necessary, with the same cosmetic product or with another cosmetic product.

Furthermore, the first part 12 is easily placed in the covering 16 because there is no need to specifically orient the first part 12 relative to the covering 16.

As a variant, the cosmetic product is a cosmetic makeup product such as a mascara or a cosmetic care product.

In another variant, the flexible indexing tab is carried by the first part 12 and the indexing surface is defined on the covering 16.

The invention claimed is:

1. A packaging and application device for a cosmetic product, comprising:

a first part for containing a cosmetic product, the first part extending along a longitudinal axis (D) between a first end and a second end, a covering able to be moved between an engaged position, in which the covering covers at least partly the first part, and a free position, in which the covering is separated from the first part, the displacement between the engaged position and the free position being made by translation of the covering along the longitudinal axis (D) away from the first part from the second end of the first part, wherein one of the first part and the covering comprises at least one flexible indexing tab projecting longitudinally, the other of the covering and the first part comprising an indexing surface, the flexible indexing tab being able to engage reversibly with the indexing surface to hold the covering in the engaged position, and wherein the flexible indexing tab can be deformed transversely between a rest position and a deformed position, wherein, when the covering is in the engaged position, the flexible indexing tab engages on the indexing surface in the rest position, which maintains the covering in the engaged position, the flexible indexing tab being adapted to be deformed from the rest position to the deformed position such as to no longer be contact with the indexing surface such hat the first part can be displaced away from the covering along the longitudinal axis, and in that the movement from the engaged position to the free position can be controlled by manually pulling the covering relative to the first part in translation along the longitudinal axis and away from the first part, manually pulling disengaging the flexible indexing tab from the indexing surface.

2. The device according to claim 1, wherein the movement from the engaged position to the free position can be made only by translation of the first part relative to the covering without movement of an element of the first part relative to the remainder of the first part and without movement of an element of the covering relative to the remainder of the covering other than a movement of the indexing tab.

3. The device according to claim 1, wherein the covering comprises a peripheral wall and a back wall substantially orthogonal to the longitudinal axis, the peripheral wall and the back wall delimiting a reception cavity of the first part, the back wall being permanently fixed relative to the peripheral wall and closing the reception cavity.

4. The device according to claim 3, wherein the other of the covering and the first part comprises a tube with an internal peripheral surface, the indexing surface being defined on the tube.

5. The device according to claim 1, wherein the deformable flexible indexing tab can move from the rest position to the deformed position only by pulling the first part relative to the covering along the longitudinal axis (D).

6. The device according to claim 1, wherein the flexible indexing tab comprises a longitudinal body and a head projecting radially from the longitudinal body applied on the indexing surface.

7. The device according to claim 1, comprising a single flexible indexing tab for cooperating with the indexing surface.

8. The device according to claim 1, wherein the first part is a support and deployment mechanism for a block of cosmetic product, the mechanism comprising a cup that can be displaced longitudinally between a retracted position and an extended position.

9. A kit containing a packaging and application device for a cosmetic product according to claim 1 and a refill comprising a first additional part similar to the first part, the first additional part extending along a longitudinal axis (D) between a first end and a second end, the covering being able to be moved between an engaged position in which the covering at least partly covers the first additional part, and a free position in which the covering is separated from the first additional part, the displacement between the engaged position and the free position being made by translation of the covering along the longitudinal axis around the first additional part from the second end of the first additional part.

10. The kit according to claim 9, comprising a substitution covering, distinct from the covering, the substitution covering being able to be moved between a free position in which the substitution covering is separated from the first part and an engaged position in which the substitution covering at least partly covers the first part, the displacement between the free position and the engaged position being made by translation of the substitution covering along the longitudinal axis (D) around the first part from the second end of the first part.

11. A method for covering/uncovering a packaging and application device for a cosmetic product, comprising the following steps:

providing a first part extending along a longitudinal axis (D) between a first end and a second end, providing a covering, one of the first part and the covering comprising a flexible indexing tab projecting longitudinally, and the other of the first part and the covering comprising an indexing surface, displacing the covering towards an engaged position, in which the covering at least partly covers the first part, the displacement being carried out by translation of the covering along a first direction along the longitudinal axis, from the second end of the first part, wherein the flexible indexing tab can be deformed transversely between a rest position and a deformed position, the flexible indexing tab being reversibly engaged with the indexing surface in order to hold the covering in the engaged position with the flexible indexing tab in the rest position, wherein the covering is maintained in the engaged position, deforming the flexible indexing tab to the deformed position such as to no longer be in contact with the indexing surface such that the first part can then be displaced away from the covering along the longitudinal axis, and manually pulling to displace the covering from the engaged position to a free position, in which the covering is separated from the first part, the displacement being carried out by translation of the covering along a second direction opposite to the first direction along the longitudinal axis, from the second end of the first part.

12. The method according to claim 11, wherein the movement from the engaged position to the free position is made exclusively by pulling the covering relative to the first part along the longitudinal axis and away from the first part, the pulling disengaging the flexible indexing tab and the indexing surface, without movement of an element of the first part relative to the remainder of the first part and without movement of an element of the covering relative to the remainder of the covering other than the movement of the flexible indexing tab.

13. The device according to claim 2, wherein the covering comprises a peripheral wall and a back wall substantially orthogonal to the longitudinal axis (D), the peripheral wall and the back wall delimiting a reception cavity of the first part, the back wall being permanently fixed relative to the peripheral wall and closing the reception cavity.

14. The device according to claim 2, wherein the flexible indexing tab projects longitudinally and can be deformed transversely between a rest position engaged on the indexing surface and a deformed position clear of the indexing surface.

15. The device according to claim 3, wherein the flexible indexing tab projects longitudinally and can be deformed transversely between a rest position engaged on the indexing surface and a deformed position clear of the indexing surface.

16. The device according to claim 2, wherein the flexible indexing tab comprises a longitudinal body and a head projecting radially from the longitudinal body applied on the indexing surface.

17. The device according to claim 3, wherein the flexible indexing tab comprises a longitudinal body and a head projecting radially from the longitudinal body applied on the indexing surface.

* * * * *